United States Patent [19]

Rush et al.

[11] 4,269,377

[45] May 26, 1981

[54] DOOR CONTROL FOR TRAIN VEHICLES

[75] Inventors: Donald L. Rush, Penn Hills; Jayant K. Kapadia, Pleasant Hills, both of Pa.

[73] Assignee: Westinghouse Electric Corp., Pittsburgh, Pa.

[21] Appl. No.: 920,104

[22] Filed: Jun. 28, 1978

[51] Int. Cl.[3] ..... B61L 3/00

[52] U.S. Cl. ..... 246/182 B; 246/187 B; 364/426

[58] Field of Search ..... 246/182 B, 187 B, 63 R, 246/4, 5; 364/426, 436; 303/20

[56] References Cited

U.S. PATENT DOCUMENTS

| | | | |
|---|---|---|---|
| 3,775,750 | 11/1973 | Woods | 340/171 R |
| 3,794,834 | 2/1974 | Aver, Jr. et al. | 246/187 B |
| 3,810,681 | 5/1974 | Matty | 303/20 |
| 3,884,437 | 5/1975 | Linderman | 246/187 B X |
| 3,958,783 | 5/1976 | Rhoton | 246/182 B |
| 4,017,044 | 4/1977 | Anderson et al. | 246/182 B |

*Primary Examiner*—J. D. Miller
*Assistant Examiner*—Reinhard J. Eisenzopf
*Attorney, Agent, or Firm*—R. G. Brodahl

[57] ABSTRACT

A passenger vehicle door control apparatus and method, including programmed computer control apparatus responsive to open door code signals from the wayside in addition to a zero signal to indicate that the train of vehicles has stopped within a passenger station are operative to open the doors of all vehicles at the correct time on the correct side of the train when the train is within the station and traveling at less than a predetermined zero speed.

11 Claims, 13 Drawing Figures

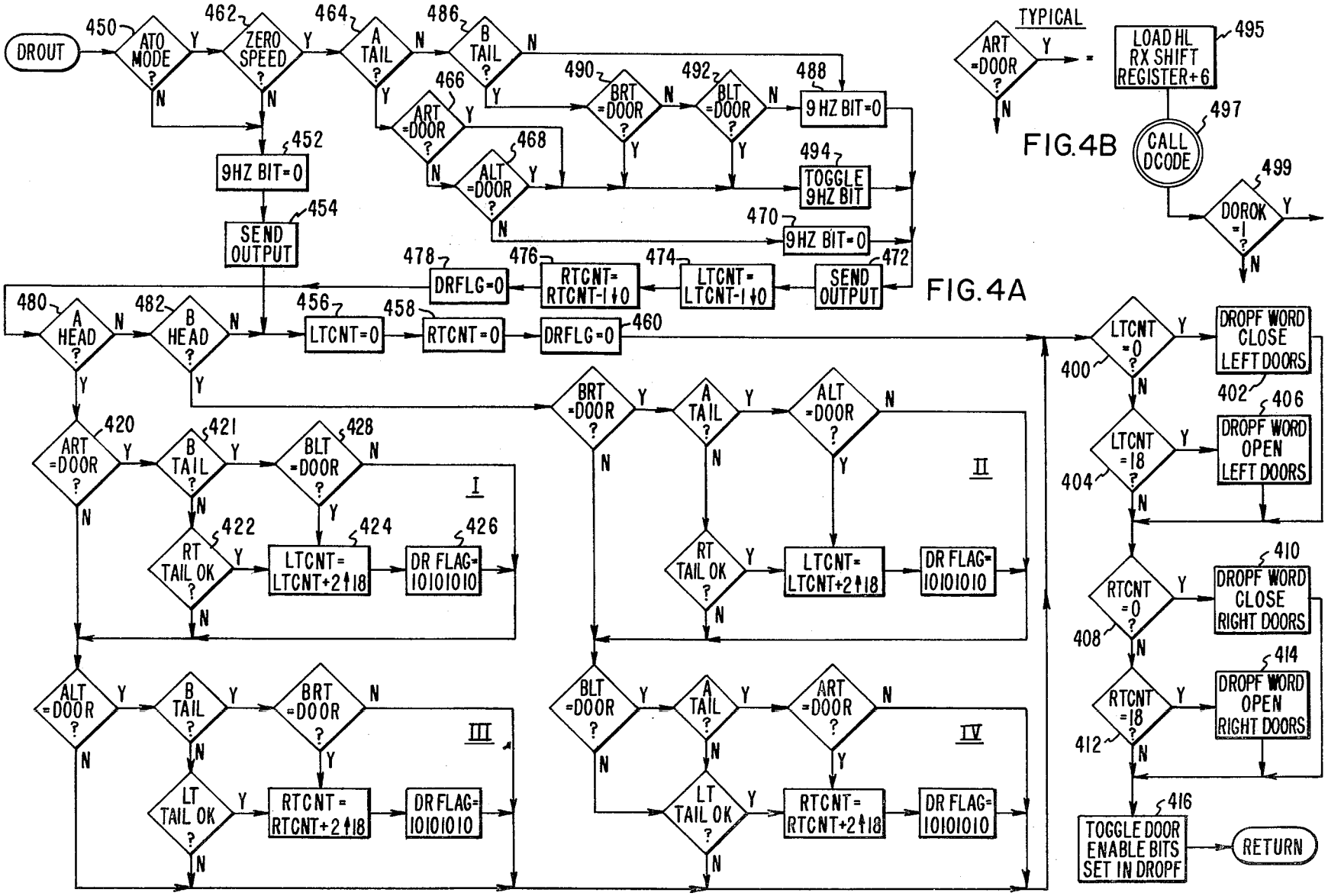
DROUT
450
ATO MODE ?
462
ZERO SPEED ?
464
A TAIL ?
486
B TAIL ?
466
ART =DOOR ?
468
ALT =DOOR ?
490
BRT =DOOR ?
492
BLT =DOOR ?
488
9 HZ BIT=0
494
TOGGLE 9HZ BIT
470
9HZ BIT=0
452
9HZ BIT=0
454
SEND OUTPUT
472
SEND OUTPUT
474
LTCNT= LTCNT-1↓0
476
RTCNT= RTCNT-1↓0
478
DRFLG=0
460
DRFLG=0
458
RTCNT=0
456
LTCNT=0
482
B HEAD ?
480
A HEAD ?
420
ART =DOOR ?
421
B TAIL ?
422
RT TAIL OK ?
424
LTCNT= LTCNT+2↑18
426
DR FLAG= 10101010
428
BLT =DOOR ?
I
ALT =DOOR ?
RT TAIL OK ?
LTCNT= LTCNT+2↑18
DR FLAG= 10101010
BRT =DOOR ?
II
ART =DOOR ?
A TAIL ?
LT TAIL OK ?
RTCNT= RTCNT+2↑18
DR FLAG= 10101010
BLT =DOOR ?
III
ALT =DOOR ?
B TAIL ?
LT TAIL OK ?
RTCNT= RTCNT+2↑18
DR FLAG= 10101010
BRT =DOOR ?
IV
LTCNT =0 ?
400
DROPF WORD CLOSE LEFT DOORS
402
LTCNT =18 ?
404
DROPF WORD OPEN LEFT DOORS
406
RTCNT =0 ?
408
DROPF WORD CLOSE RIGHT DOORS
410
RTCNT =18 ?
412
DROPF WORD OPEN RIGHT DOORS
414
TOGGLE DOOR ENABLE BITS SET IN DROPF
416
RETURN
TYPICAL
ART =DOOR ?
FIG.4B
495
LOAD HL RX SHIFT REGISTER+6
497
CALL DCODE
499
DOROK =1 ?
FIG.4A

DOOR CONTROL FOR TRAIN VEHICLES

CROSS-REFERENCE TO RELATED APPLICATIONS

The present application is related to the following concurrently filed patent applications which are assigned to the same assignee as the present application; and the respective disclosures of which are incorporated herein by reference:

1. Ser. No. 920,319 which was filed on June 28, 1978 by L. W. Anderson and A. P. Sahasrabudhe and entitled "Speed Maintaining Control Of Train Vehicles" and issued as U.S. Pat. No. 4,217,643;
2. Ser. No. 920,318, which was filed on June 28, 1978 by D. L. Rush and entitled "Program Stop Control of Train Vehicles" and issued as U.S. Pat. No. 4,208,717;
3. Ser. No. 920,317, which was filed on June 28, 1978 by D. L. Rush, L. W. Anderson and M. P. McDonald and entitled "Speed Decoding And Speed Error Determining Control Apparatus And Method" and issued as U.S. Pat. No. 4,209,828;
4. Ser. No. 920,043, which was filed on June 26, 1978 by M. P. McDonald, T. D. Clark and R. H. Perry and entitled "Train Vehicle Control Multiplex Train Line";
5. Ser. No. 920,316, which was filed on June 28, 1978 by L. W. Anderson and M. P. McDonald and entitled "Train Vehicle Control Microprocessor Power Reset"; and
6. Ser. No. 920,315, which was filed on June 28, 1978 by D. L. Rush and A. P. Sahasrabudhe and entitled "Desired Velocity Control For Passenger Vehicles".

BACKGROUND OF THE INVENTION

The present invention relates to the automatic control of passenger vehicles, such as mass transit vehicles or the like, and including speed control and speed maintenance while moving along a track, precise stopping of the vehicles in relation to passenger loading and unloading stations and the operation of the vehicle doors.

In an article entitled The BARTD Train Control System published in Railway Signaling and Communications for December 1967 at pages 18 to 23, the train control system for the San Francisco Bay Area Rapid Transit District is described. Other articles relating to the same train control system were published in the IEEE Transactions On Communication Technology for June 1968 at pages 369 to 374, in Railway Signaling and Communications for July 1969 at pages 27 to 38, in the Westinghouse Engineer for March 1970 at pages 51 to 54, in the Westinghouse Engineer for July 1972 at pages 98 to 103, and in the Westinghouse Engineer for September 1972 at pages 145 to 151. A general description of the train control system to be provided for the East-West line of the Sao Paulo Brazil Metro is provided in an article published in IAS 1977 Annual of the IEEE Industry Applications Society at pages 1105 to 1109. It is known in the prior art to provide a coded control signal and to detect that coded control signal for controlling a relay driver, such as a door control relay driver, such as disclosed in U.S. Pat. No. 3,775,750 of D. H. Woods.

A general description of the microprocessors and the related peripheral devices is provided in the Intel 8080 Microcomputer Systems Users Manual currently available from Intel Corp., Santa Clara, Calif. 95051.

SUMMARY OF THE INVENTION

An improved passenger vehicle door control apparatus and method are provided for response to open door code signals from a passenger station where it is desired that the train of vehicles will stop to load and unload passengers. The vehicle doors open only if door code signals are received at the front and at the rear of the train, and the program computer control apparatus recognizes valid door control signals to provide a dynamic enable signal. In addition, a zero speed signal is required to indicate the train is stopped.

BRIEF DESCRIPTION OF THE DRAWINGS

FIGS. 4A and 4B functionally illustrate the door open control routine;

DESCRIPTION OF A PREFERRED EMBODIMENT

Figure 1:
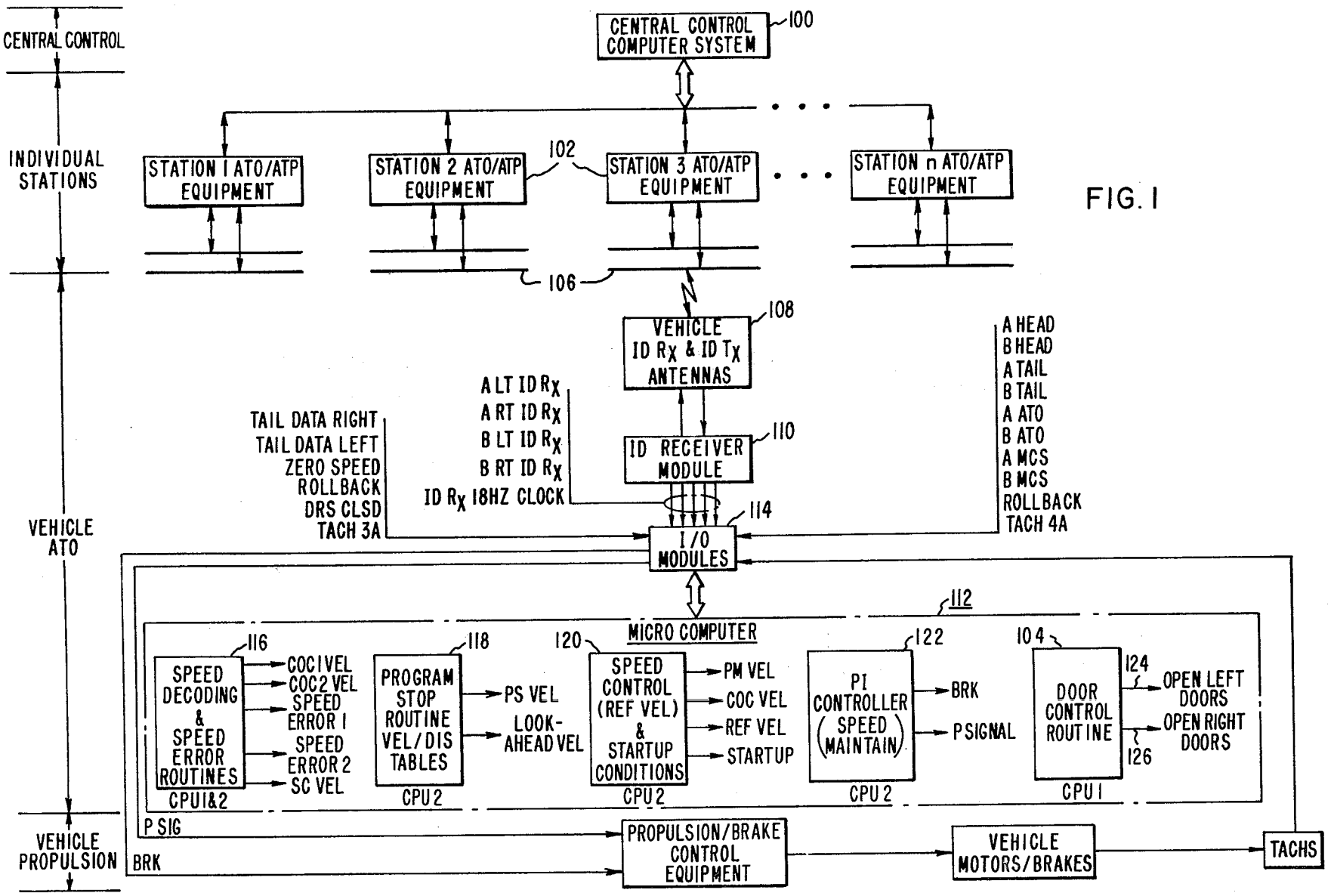
FIG. 1 is a schematic showing of the passenger vehicle control system including the present door control routine.

In FIG. 1 there is shown the central control computer system 100 having an interface with the vehicle doors in the form of display lights on an operator's panel which indicate that the vehicle doors are open or not. The station ATO/ATP equipment 102 is provided in each of the passengers' stations as shown. The door control program 104 within the microcomputer CPU 1 interfaces when the station requests that the vehicle doors be opened and the station ATO/ATP equipment will receive a signal back from the train vehicle when the doors are open. The antennas 106 are provided in each station and these are the ID receiving and transmitting antennas with one being in each station and with the length of the antenna being substantially the same length as the station to make sure that the train is within the station before the doors are allowed to open. The vehicle 108 includes the ID receiver and ID transmitter antennas, with each pair of cars having four receiving antennas in the arrangement of one at each corner of the pair of vehicles; two antennas are on the front and two on the rear and when the vehicles are coupled together to make up a train, the other antennas are cut off and not used except for the front and the back antennas. There are two ID transmitters with one being provided for each side of the train. The ID receiver module 110 is in the ATO rack on the car, and the signals picked up from the antennas go into this module where they are level detected and so forth. There are five signals shown to the left of the ID receiver module that are sent from this module into the computer 112 through the I/O modules 114. These five signals include the A left receiver data, the A right receiver data, the B left receiver data, the B right receiver data, and the 18 Hz clock. Each time an interrupt is provided by the clock the inputs from all four antennas are read. Each computer CPU 1 and CPU 2 has two of the I/O modules as previously described and the signals that are listed coming into the I/O modules 114 are the signals used by the door control program 104. They are the five signals that come from the ID receiver module and the additional signals listed on each side of the page. The first eight signals shown to the right of the I/O modules 114 are signals from the master controller itself such as an A head car or a B head car, an A tail or a B tail and the operation is ATO or MCS, the next two show that the vehicle is in roll back and the tachometer 4A signal to indicate the speed of the train. The rollback signal is used to keep the doors from opening and the tachometer signal is used to start opening the doors when the train is slowed down below about 4 KPH, so all the door open control circuitry will be ready when a zero speed is detected for the doors to actually open. The tail data from the right and left side of the train indicates when a signal coming from the rear of the train to establish that the tail-end of the train is within the station. The zero speed signal is used to allow the doors to open, the doors closed signal indicates that all the doors are closed.

The zero speed signals is from the vital interlock module and is a vital zero speed signal with the tachometers being involved here, but not directly. This is a hardware zero speed signal. The microcomputer block 112 includes the door control routine 104 of the present disclosure, and the other illustrated programs 116, 118, 120 and 122 are each described in greater detail in one of the above cross-referenced related patent applications.

The door control program 104 has two outputs with one output 124 being to open the doors on the left side of the train and the other output 126 being to open the doors on the right side of the train. Each of these signals 124 and 126 is dynamic and goes to the door module shown in FIG. 6 where it is handled vitally and controls the opening of the doors. When a train of several vehicles is running down the track and comes into a passenger station and stops, the purpose of the door control routine 104 is to open the doors of all vehicles at the correct time on the correct side and then only if the train is within the station and traveling at less than a predetermined speed. The vehicle antennas sense the door open signal that is sent out from the station and the wayside to the train. If this signal is received on the left side of the train, the door control should open the right side doors because the station door open signal is transmitted from the opposite side of the track in relation to the passenger platform since it is easier to lay the door control antenna on the opposite side of the track where there is no platform. When the train comes into the station if the platform is on the left side of the track, the door control should open the left doors; and if the platform is on the right side of the track, the door control should open the right doors; and if there are platforms on both sides of the track, the door control should open the doors on both sides together or in sequence as may be desired. From the train back to the station, as soon as the doors are open there is sent a signal over the ID transmitter which says the doors on the train are opened, and this happens only if both the front end and the rear end of the train are in the station. The here disclosed door control system actually decodes both the door open signal received at the tail of the train and the door open signal received at the head of the train to be certain that both proper door codes signals are received.

The prior art door control system made a check to determine that there was dynamic data being received and on occasion some signal information other than a legitimate door open signal might cause a train vehicle's door to open, whenever any one antenna on the vehicle received a dynamic signal that appeared to be a door control signal. The present door control system is more reliable since it decodes and makes sure that the received signal is a door code before the vehicle doors are allowed to open. The prior art door control decoded the received door control signal at the front end of the train and looked for a dynamic signal at the rear. The present door control program 104 decodes a received door control signal at each of the front and the back of the train and compares them and in addition, determines that both front and back door control signals are requesting the doors be opened on the same side of the train. For example, the front door open signal if it is to open the left doors and the rear door open signal if it is to open the right doors, the present control system will not allow the doors on either side of the train to open. The door control program 104 requires receiving sixteen door code bits in the right sequence before the doors are opened, and there is no combination of ID's or other related signals that will give that long of what appears to be a door code signal.

Figure 2:
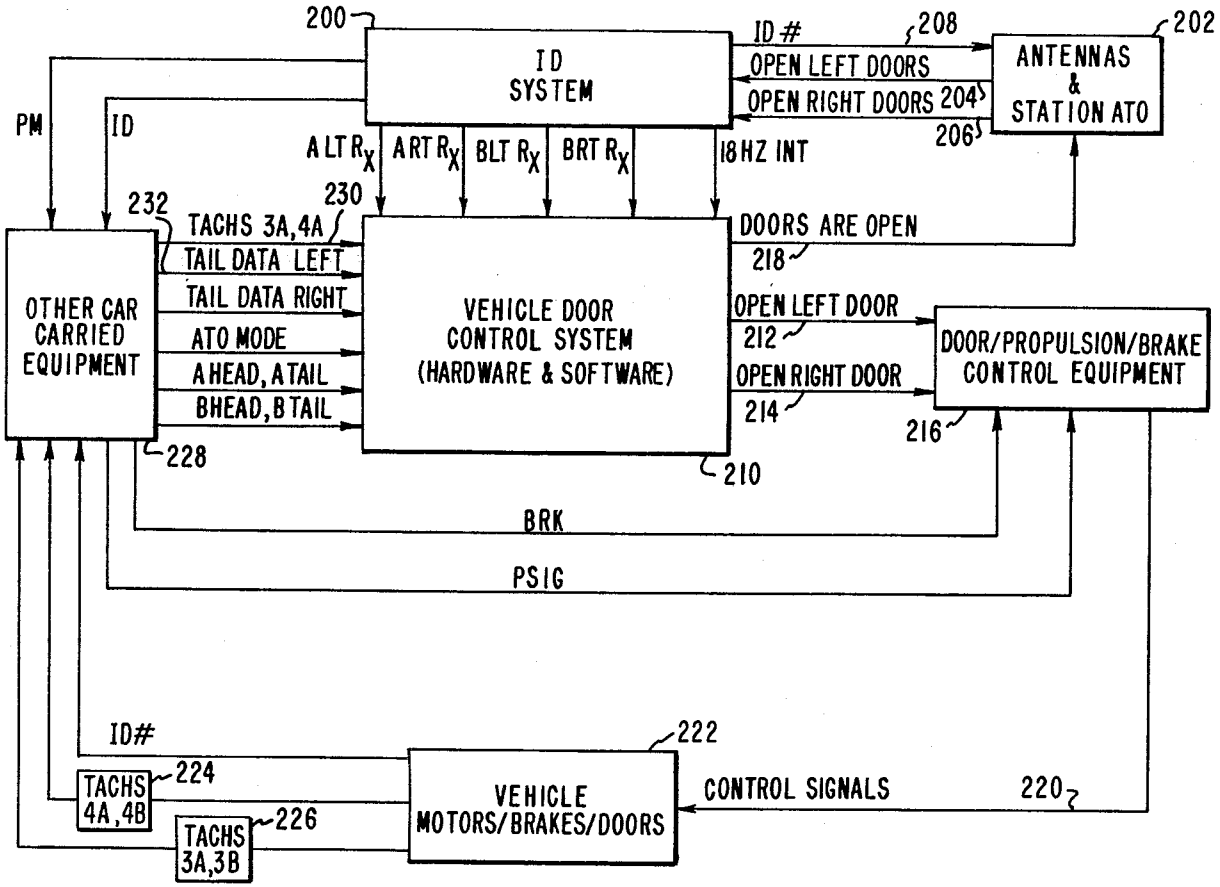
FIG. 2 illustrates the vehicle door control system of the present invention in relation to the train operation information supplied to that system for a given passenger vehicle.

In FIG. 2 there is shown a block diagram of the present passenger vehicle door control system. The ID system 200 is well known in the prior art and a suitable example of such a system has been operating for over two years in Sao Paulo, Brazil and is described in the above-referenced September 1972 article in the Westinghouse Engineer. Input signals to the ID system 200 come from the wayside antennas and station ATO 202, and are the open left doors signal 204 and the open right doors signals 206. An output signal 208 from the ID system to the antennas and station ATO 202 is the ID number of the train, and that number tells the station what the train number is. Coming out from the bottom of the ID system 200 are the five signals from the ID system shown in FIG. 1 coming out of the ID receiver module 110. They are the four data bits from the four receivers and the 18 Hz interrupt. These five signals go into the vehicle door control system 210. Two signals come out of the vehicle door control system, namely the open left door signal 212 and the open right door signal 214 and go to the vehicle door propulsion and brake control equipment 216. A third signal 218 is sent to the station to indicate that the doors are open. The open left door signal 212 and the open right door signal 214 are output from the hardward door module board shown in FIG. 6. The door propulsion and brake control equipment 216 on the car provides an output signal 220 to the vehicle motors, brakes and doors 222. The tachometers 224 and 226 are coupled to the vehicle and output actual speed signals to the other car-carried equipment 228, which is essentially the rest of the control apparatus other than the vehicle door and the ID system. The other car-carried equipment 228 supplies tachometer inputs 230 to the vehicle door control system 210 and in addition, the tail data left signal, the tail data right signal, the ATO mode of operation, the A head, and the A tail signal, and the B head and the B tail signal. The output signal 212 and 214 are vital control signals to control opening the left doors, opening the right doors and the door open indication signal to the station 202.

The vehicle door control system 210 shown in FIG. 2 is provided to control the doors on each car of the train. The train has two antennas on each end with one antenna on each of the left, front and back of the train and one antenna on each of the right, front and back of the train. Door open signal information is received adjacent to each station from these antennas at all times and this signal information is input into the software shift registers. When the train is running away from a station the door control system just ignores any door signals it may receive and does not respond to them. When the tachometers output a zero speed this indicates the train is stopped in a station, so at this point in time the program starts looking at input door open signal information to the shift registers from the antennas. The only time the doors should open is when the train is stopped so there is no reason to even bother looking at the door signals unless the train is stopped. When the train is moving less than 4 KPH, the vehicle door control system 210 prepares to open the doors, because of the time delays in the relays and other apparatus to begin the doors on the way open. The doors will not actually open until the vital zero speed signal is detected, but all the pre-preparation is done to get ready to open the doors at the time the train actually stops. With antennas on the front of the train and on the back of the train, when a train pulls into a station and it stop the vehicle door control system requires that both the front and the back antennas are receiving information or else the train has missed the station, and if the train has missed the station, the doors should not open. The vehicle door control system starts looking as soon as the train stops and then unless door open signal information is received on both the front and the back of the train, the doors are not allowed to open. The controlling computer CPU 1 is in the front end of the train and it needs to know what is going on in the rear of the train, so it responds to a tail-end door open signal for this purpose which is brought to the front of the train. The door open code must be received in the rear of the train, which door open code is 101010 continuously, so the front end computer has to determine that a door open code signal is received at both the front end and the tail end of the train. The front end computer, in order to check the door code signal, uses a 54 Hz interrupt such that every 54th of a second an interrupt is provided and a check is made of the data, is it high or low, and records it such that every six times the 54 Hz clock interrupt is provided a good door open signal will change state if it is 101010.

In FIG. 3 at block 300 the 54 Hz interrupt is received. Block 302 inputs the right tail data. Block 304 compares it with the past value obtained 1/54 second ago, and if they are the same at block 306, and the present value is the same as the past, this means that it did not change state and block 308 increments the counter. If they were not the same in block 306, this indicates a change of state and at block 310 the new data is stored to be used on the next cycle as a past value. At block 312 the O.K. flag is set to one and block 314 sets the counter equal to zero. At block 316 a check is made to see if the count is equal to 7. If the answer is no, the program goes to block 318 to check the left tail data. If the answer is yes at block 316, then block 320 sets the counter to zero because that count should never reach 7 since there are six cycles of 54 Hz for each cycle of 9 Hz so that count should never reach 7. If it does, some other frequency is being received other than the desired signal frequency and at block 320 the counter is set to zero, and at block 322 the O.K. flag is set to zero to indicate the right doors are not O.K. to open. If the counter reaches 7, the tail end data has not changed at the correct rate so something is wrong somewhere and it is not desired to open the doors, and zero means do not open the doors. Blocks 318 and 324 through 342 are substantially the same as blocks 302 through 322 for the other side of the train left tail data. The sides of the train operate independently, since the left doors can open, the right doors can open, and both left and right doors can open if desired. A signal from the right side of the train opens the left doors and a signal from theleft side of the train opens the right doors.

Figure 3A:
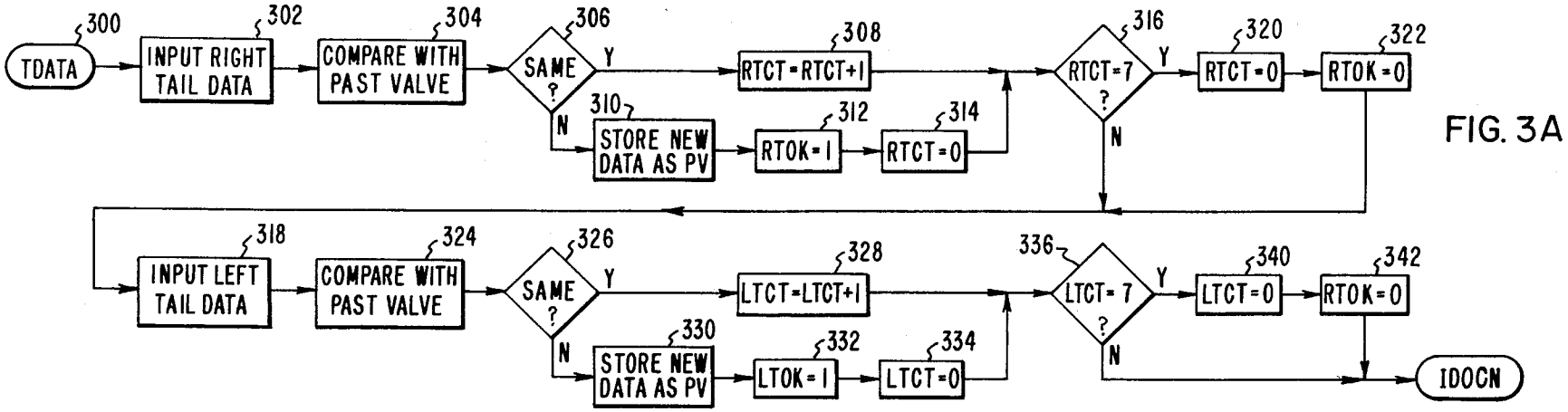
FIGS. 3A and 3B functionally illustrate the input door code data routine and the door open code check routine.

In FIG. 3A the input door open data is decoded and it is assured to be at a 9 Hz rate because a counter is used to make sure the input frequency is correct.

Figure 5:
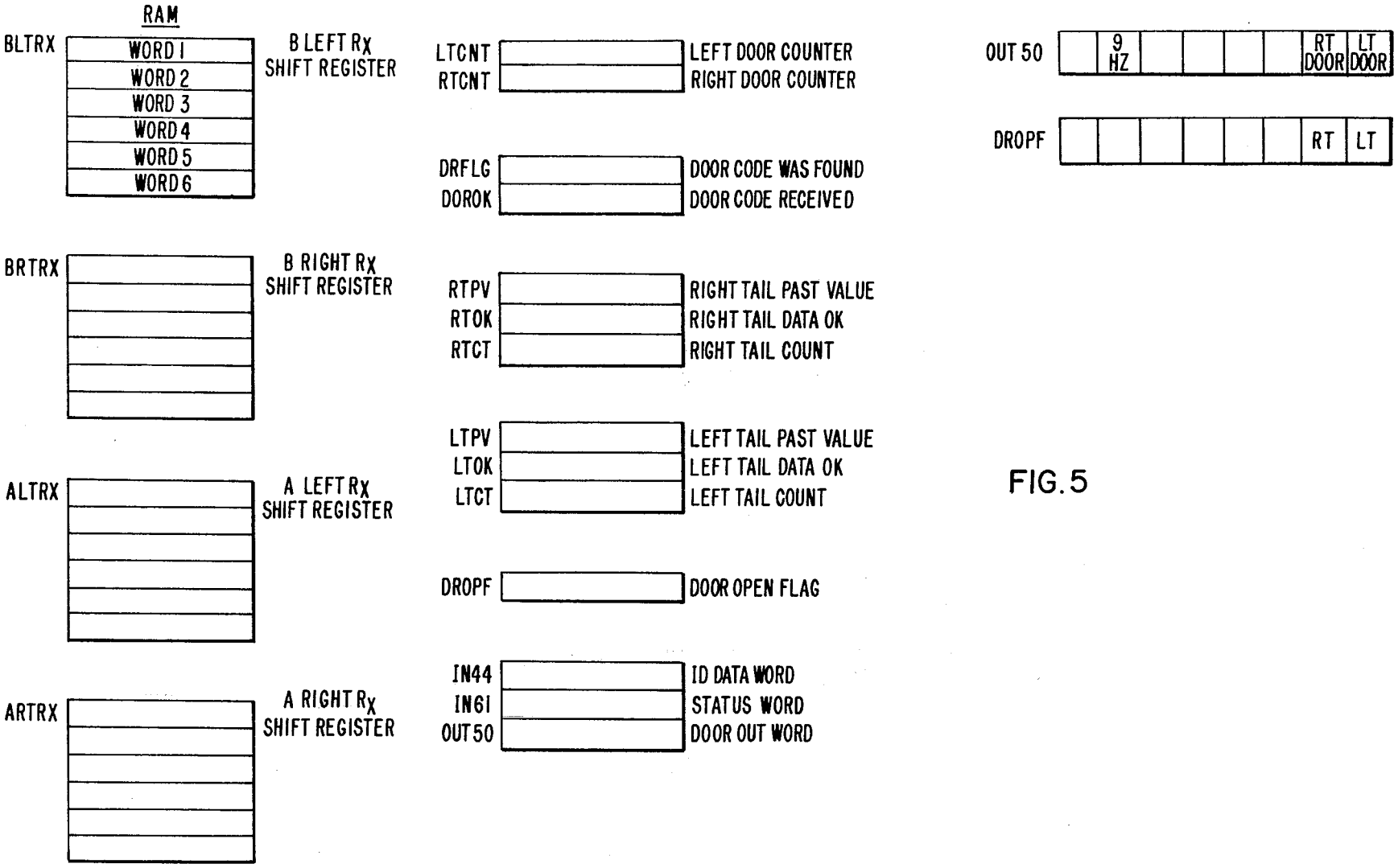
FIG. 5 shows the door code word storage in memory shift register locations and related information in data storage address locations.

In FIG. 5 there are shown the tables stored in RAM memory. These include four six-word shift registers for each of the four door signal ID antennas. Assuming the car has A cars and B cars, the top table is the shift register for the B left receiver, the second table is for the B right receiver, the third is for the A left and the fourth is for the A right. In relation to the software shift registers, door code information is shifted into them continuously every 18th of a second and there is a bit shifted into all four registers whether the respective antenna is on or off and whether the vehicle is stopped or moving. The different programs decide when this information should be looked at. There is a door flag which indicates a door code is in the shift registers and the door O.K. flag which indicates a door code is being received. The left door counter and the right door counter are shown and the rest of the tables are for the inputs and the outputs. The tail data indicates to the controlling computer in the front of the train that the rear end of the train is in the station receiving the door code or it is not receiving the door code.

FIG. 4A is a flow chart for the main door control routine. It includes several sections. When going through the door routine there is a need to know if a door open code is received or not so there is a subroutine called decode shown in FIG. 3B that determines whether there was a door code input into the shift registers. At block 350 a check is made to see if word 5 is equal to word 6 to establish in relation to the 6 word shift register are the last two words alike and this requires 8 successive patterns in a row. If they are not the same, at block 352 the door O.K. flag is set to zero to indicate a proper door code is not received. In block 350 if they were equal, now it should be determined that the words were a door code which is 101010. The signal could instead be 010101, so a check is made for both possibilities. Block 354 checks to see if the input code is equal to a 55 hex, which is 01010101. If the answer was yes at block 354, it is a door code and at block 356 the door O.K. flag is set equal to 1. At block 354 if it was not a 55 hex, a check is made at block 358 to see if it was equal to AA hex, which is 10101010. If the answer is yes, it is a door code and at block 356 the door O.K. flag is set equal to 1. If the answer is no at block 360, the door O.K. flag is set equal to zero. This subroutine called by the main door control routine looks at the previous input code transmissions and comes out with the door O.K. set to zero for a not good door code and set to 1 for a good door code.

When all the input door codes are satisfactory and everything agrees, the train is in the station, is stopped and the proper side is indicated to open the doors, a dynamic signal is output which toggles every 18 Hz of a second that comes out to be a 9 Hz square wave, and this goes to the door hardware logic control module which actually opens the door. It is necessary to decide whether to toggle that enable bit or not and due to the fact that noise and other disturbances can affect the door code transmissions for each good door received a counter is set from zero to 18 in steps of 2. If 9 good door codes are received in a row, the counter gets incremented up to 18 and now it is permitted to open the doors. If the next bit for some reason came in bad, the doors will not close immediately but the counter will count down and the next time a bad signal is received it will count down again. Two such counters are running, one for the left doors and one for the right doors, and they go from zero to 18 and back down to zero. As good codes are received the counter counts up. As soon as the counter hits 18 this starts toggling the enable bit and continues to toggle that bit until the number decreases to zero, which in effect provides a confusion zone type of logic. The next section of the program is checking the counter to see if good door codes are being received. At block 400 of FIG. 4A a check is made to see if the left door counter is equal to zero. If the answer is yes, at block 402 the flag is set to close the left doors because the counter has gone down to zero. If the counter was not zero at block 400, at block 404 a check is made to see if the count is equal to 18. If the answer is yes, then at block 406 set the flag to open the doors and this is the good door code case. Then at block 408 a check is made of the right counter to see if it is equal to zero. If the answer is yes, then at block 410 set the flag to close the doors. If the answer is no, at block 412 is check is made to see is it equal to 18. If yes, set the flag at block 414 to open the doors and then from both paths go to block 416 which toggles the door enable bit for either one of the two flags that is set. If both of these flags are set, then toggle both left and right door enable bits. For any number between zero and 18 the flag words are not changed since they are only set at the two trigger points, zero and 18. Each time through the program these checks are made to see if the counters are zero of 18, and if not, then toggle the bit. This section of program uses information that has been determined before and toggles the door open enable bits or not. There are four door open sections of the program and they are substantially identical except that each one pertains to a different door code antenna. The first section is for the A car and right side antenna. At block 420 a check is made to see if the A right antenna is receiving the door code, and this is determined by going through the subroutine shown in FIG. 3B. If the answer is no, the rest of the routine is not done and the program checks some other antenna. If it was a door code at block 420, then at block 421 a check is made to see is this car a tail because if it is not the tail car, there is a need for different information. Assume in block 421 this is not a B tail which says it is not a B car on the rear end of the train. At block 422 a check is made to see if the right tail information is O.K. This is the signal from the tail data routine shown in FIG. 3A. If it is not O.K., again this routine is terminated. In all cases when there is a failure to pass a check the program goes to check the next block. If the tail data was good at block 422 and good data is received, the counter is incremented. This is the counter previously checked at block 400 and block 424 increments the counter by adding 2 up to a limit of 18. At block 426 the door flag is set to 10101010, which is the door code and the program goes to check the next antenna. At block 422 if this was a B tail, it means the last car on the train is a B car and there is an antenna on that car to receive the door code. At block 428 a check is made to see if B left is equal to door code. If the answer is no, the routine ends, and if the answer is yes, it is a good door code so at block 424 increment the counter, set the door flag block 426 and leave. This program section takes one antenna and checks to see for a front antenna, and if there is a door signal. If the answer is yes, it checks the rear end to see if there is a door signal. There are two places to check this information, one is from a real antenna (2 car train) and the other is in relation to information brought forward upon the train line. A good door code count increments the counter, and a bad count does nothing to the counter. Large block sections I, II, III and IV are functionally the same except each one is for a different set of antennas and in relation to either an A head car or a B head car.

The door control routine shown in FIG. 4A begins at block 450, which checks if it is the ATO mode of operation. If the answer is no, the door routine is not done, only some bookkeeping. If at block 450 this is not the ATO mode, at block 452 a 9 Hz toggle bit is set to zero because if the operation is not in the ATO mode, there is no need to toggle this bit. Block 454 sends the zero bit out to the hardware door control module. Block 456 sets the left counter to zero, which is one of the counters that are counted up and down between zero and 18 in steps of 2. Block 458 sets the right side counter to zero. Block 460 sets the door flag to zero and the program goes to block 400, which was described before. If the answer at block 450 was yes, at block 462 a check is made to see if the vehicle is at zero speed, which zero speed here means something close to zero, and this could be up to a predetermined limit such as 4 KPH. If the answer is no, that means the vehicle is moving too fast and the program goes through blocks 452, 454 and so forth. If the answer at block 462 is yes, the vehicle is at zero speed and probably stopped at a station, so at block 464 a check is made to see if an A car is at the tail of a train. The tail car (A or B) checks to see if the rear of the train is receiving a door open code. If it is, the signal is sent to the front of the train at a 9 Hz rate. Block 464 is looking for an A car in the rear end. If the answer is yes, at block 466 a check is made to see if an A right door open code is being received. If the answer is no, it is not an A car right door open code, and at block 468 a check is made to see if it is an A car left door open code. If the answer is no, that means the rear of the train is not in a station. At block 470 the toggle bit is set to zero and the output is sent at block 472 similar to block 454 and at block 474 the left counter is counted down toward zero. At block 476 the right counter is counted down towards zero, the door flag is set in block 478 to zero, which means no door code was found. At block 480 a check is made to see if this is an A head end car. If the answer is yes, the program goes to block 420, which was previously discussed. If it is not an A head end car, at block 482 a check is made to see if this is a B head end car. If it is a B head end car, at big block II another antenna checking subroutine is followed in the same way that the big block I was previously described. If the answer is no at block 482, the initialization procedure is followed again because there can be six car trains and this particular set of equipment could be in a middle car, such that it was not an A head end, not a B head end, not an A tail and not a B tail, but the program computer control system does not know where it is in relation to the rest of the train. It is the A head end or the B head end computer control system that controls the car doors on the whole train. The described program checks in regard to A head end cars, B head end cars, A tail and B tail cars, since the train direction has to be established in relation to left antennas and right antennas. Any car can be turned around and it can change directions, so the left and right antennas have to be established, and that is the reason for making a lot of the checks here described. Going back to block 464 if it is not an A tail, at block 486 a check is made to see if it is a B tail. If the answer is no, at block 488 the toggle bit is set to zero, and block 472 sends it out and the program goes through the same countdown process as before, since no door code was found. If it is a B tail at block 490, a check is made if there is a B right door open code and assuming there is not a B right door open code at block 492 a check is made to see if there is a B left door open code. If it is not, no door code has been found again, and at block 488 the toggle bit is set to zero. In this program there are four passes where a good door code can be found, one for each of the four monitored antennas on the train. From the blocks 466, 468, 490 and 492 the yes case in any of these would indicate a good door signal was received and then block 494 would toggle the 9 Hz bit, and then at block 472 output the toggle bit. The program has to see at least two door signals with one for the front and the other for the back, which signals can be from antennas or can be over the train lines. When a good door code signal pass is made through the program at blocks 474 and 476, the counters are counted down by one, and at block 424 a big block I and the corresponding block for each of big blocks II, III and IV, the counters are counted up by two. For a bad case, where no good code door signal is received, the counters are decremented toward zero and that is the reason for the different numbers in the program. Anytime a good door code signal is received a one toggle bit is sent out at blocks 494 and 472. Instead of sending out the door open control signal the program sends toggle bits to the left or right hardware door control modules, which in turn sense the vital zero speed condition of the train.

Figure 3B:
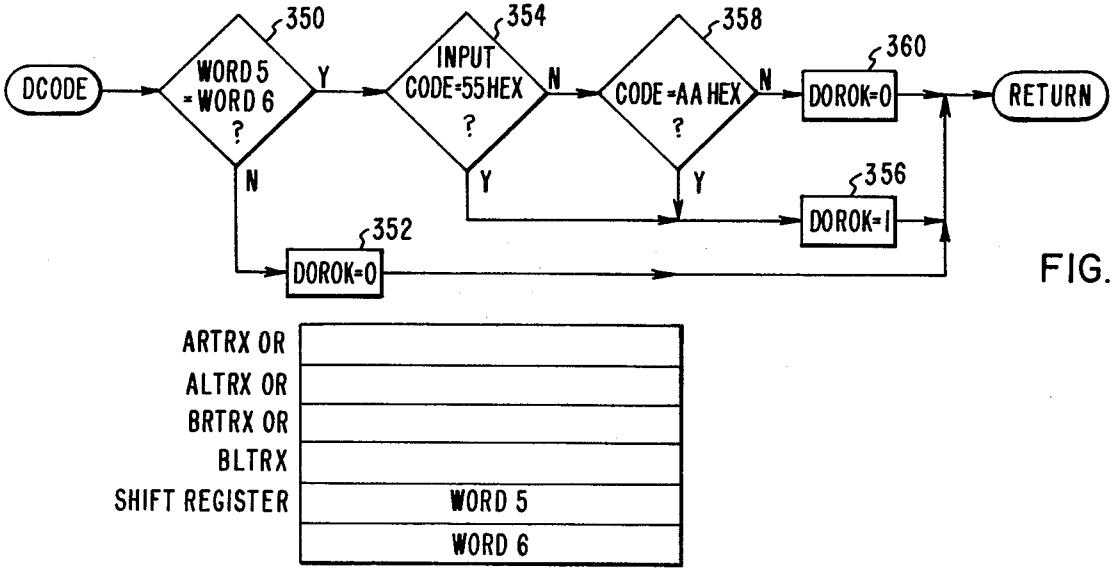

In FIG. 4B the check made at block 420 of big block I and the corresponding blocks for the big blocks II, III and IV is illustrated to include the block 495 where the right shift register address is loaded, at block 497 the decode program shown in FIG. 3B is called, and at block 499 a check is made of the door O.K. flag.

Figure 6:
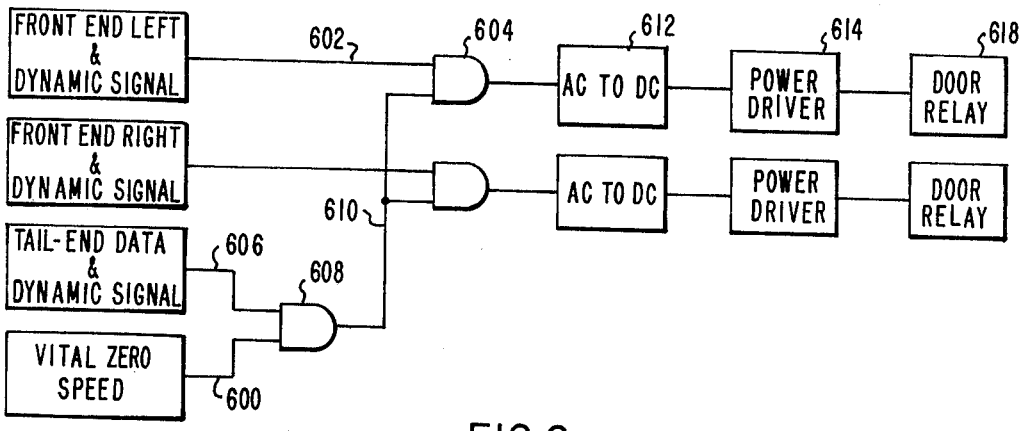
FIG. 6 schematically shows the hardware door control module operative in the vehicle door control system of FIG. 2.

The hardware apparatus schematically shown in FIG. 6 looks for the open left door signal 204 shown in FIG. 2, and the open right door signal 206 coming from the station 202. The antenna on the head-in vehicle of the train receives these signals and the antenna on the tail end vehicle receives these signals to tell the train that it is desired that all the doors on a particular side of the train are to be opened. The doors do not open unless the vehicle door control system 210, which is usually located in the head end control vehicle receives both a front end door open signal and rear end door open signal corresponding to the same side of the train and, in addition, the control computer including the door control program 104 shown in FIG. 1 provides a dynamic output signal indicating that the wayside door signals have been received, which are coded 101010. Also a vital zero speed signal 600 has to be received to indicate that the train has stopped in the station. When the front end vehicle receives a door open signal for example the open left door signal 204 shown in FIG. 2, and the door control program 104 for that front end vehicle provides the dynamic toggle enable signal, and output signal 602 is provided to one input of AND gate 604. When the tail end vehicle receives a door open signal for the same side doors, and a dynamic enable toggle signal is provided by the door control program for the microprocessor CPU 1 of that tail end vehicle, an output signal 606 is provided to one input of AND gate 608. Assume the vital zero speed signal 600 is being provided to the other input of the AND gate 608, then an output signal 610 is provided to the other input of AND gate 604 to result in the AC to DC converter 612 providing a signal to the oscillator and power driver 614 for energizing the door control relays 618, which control the door motors to open the doors.

Figure 7:
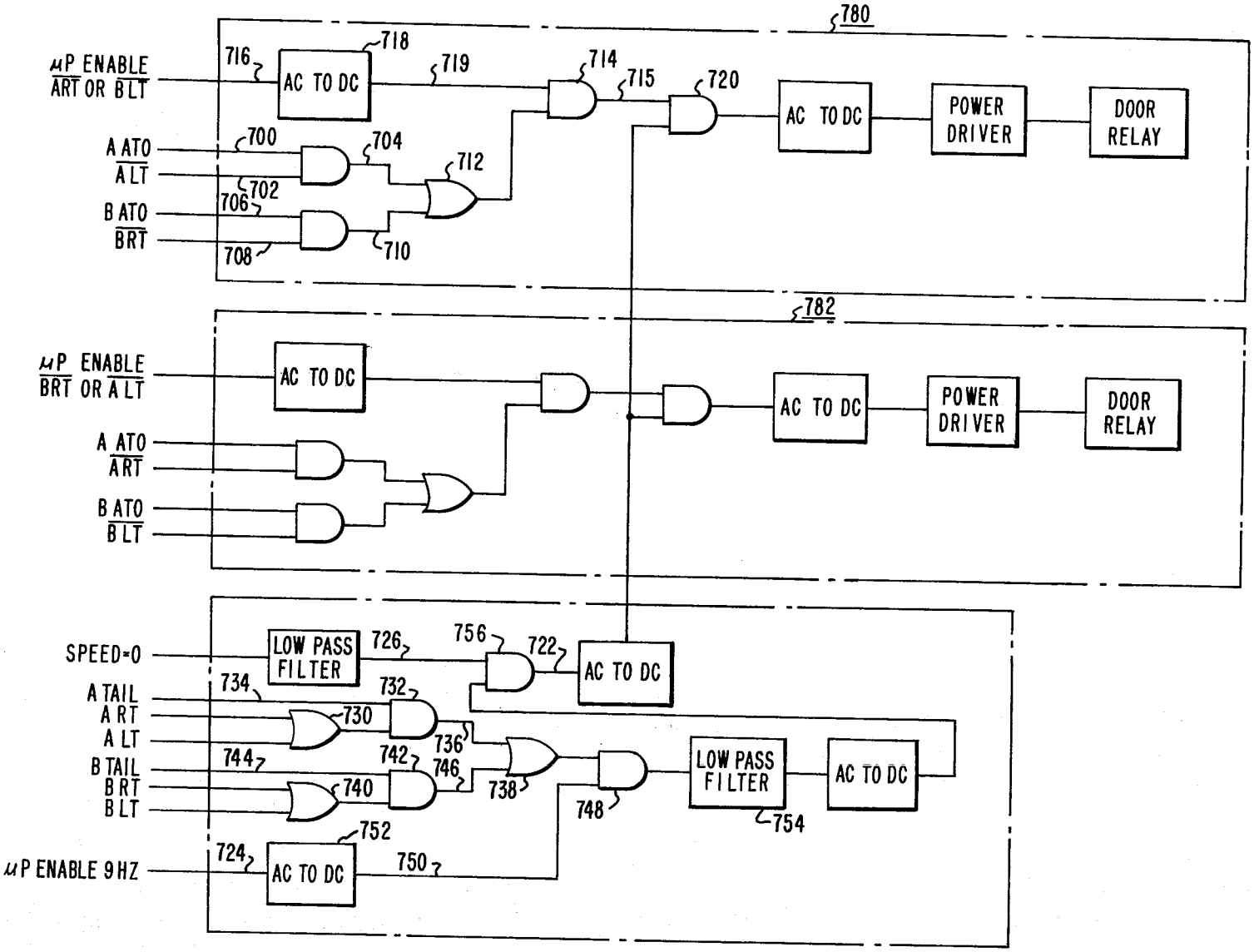
FIG. 7 shows in greater detail the door control module of FIG. 6.

In FIG. 7 there is shown in greater detail the apparatus shown in FIG. 6, with the A head ATO and the B head ATO input signals defining which is the head end of the train of several vehicles. The A left and the B right signals tell which side of the train corresponds with the station platform and is the side of the train on which the doors should open when viewed in a direction toward the front movement of the train. Thusly, the A left and the B right are paired together and the A right and the B left doors are paired together such that the doors open on the same side of the train. In the prior art door control apparatus any dynamic door open signal received by the train might cause the vehicle doors to open as long as it momentarily had the proper door open code signal of 101010 and was picked up with an adequate threshold to overcome an input signal threshold detector. The apparatus shown in FIGS. 6 and 7 provide a plurality of checks in addition to the fact that a proper door open signal code is received, namely that door open signals are received both from the front and the tail end of the train and for a corresponding similar side of the train. In addition, the microprocessor CPU 1 provides the dynamic output signal when the proper door code signal is received and this has to be received for a predetermined period of time; and a final check is made in relation to a vital zero speed condition of the train being present.

In FIG. 7 if the A head ATO signal 700 and the A left door signal 702 are present, the dynamic output signal 704 will be provided. If the B head ATO signal 706 and the B right door signal 708 are present, the dynamic output signal 710 will be provided. Either one of the dynamic signals 704 or 710 applied to OR gate 712 will result in an output signal to one input of the AND gate 714. The microprocessor dynamic toggle enable the signals 716 go through an AC to DC converter 718 to energize the other input of the AND gate 714. The output of the AND gate 714 energizes one input of the AND gate 720. The above operation in relation to AND gate 714 responded to head end door open signals from the wayside. If the front end data shows everything is all right so far, there is a dynamic signal output by OR gate 712 to one input of the AND gate 714. If the head end CPU 1 microprocessor toggle enable control voltage 719 is present, the AND gate 714 provides an output signal.

The control signal 722 is responsive to the tailend microprocessor toggle enable signal 724 at a 9 Hz rate and the B tail end data or a tail end data and that the train is stopped. This zero speed signal 726 is generated by the vital interlock board if and only if the train is stopped. The OR gate 730 responds to either one of the A right or the A left door signal. The AND gate 732 responds to the provision of an output signal from the OR gate 730 in conjunction with the A tail ATO signal 734 to provide an output signal 736 to the OR gate 738. The OR gate 740 responds to either one of the B right or the B left door signal. The AND gate 742 responds to the provision of an output signal from the OR gate 740 in conjunction with the B tail ATO signal 744 to provide an output signal 746 to the OR gate 738. The AND gate 748 responds to the provision of an output signal from the OR gate 738 in conjunction with a tail end CPU 1 microprocessor toggle enable control voltage 750 from the AC to DC converter 752. For providing an output signal through the low pass filter 754 to make sure that no high frequency signal can generate extraneous control signals. In other words, the 9 Hz enable signal 724 has to be present and should be below some frequency to generate a control voltage 750 for an output across the AND gate 748, which in turn, drives the AC to DC converter to energize one input of AND gate 756. At the same time if the train is stopped and it is at a zero speed, a vitally generated zero speed signal 726 comes in and drives the other input of AND gate 756 for providing the output signal 722.

When the signal 722 to enable opening of the vehicle doors is supplied to AND gate 720 in conjunction with the output signal 715 from the AND gate 714, the AND gate 720 provides an output signal to open the doors of all passenger vehicles in the train with the door selection circuits 780 providing an output to open the left doors of the A vehicle, and the right doors of the B vehicle. When A is the head end car, this would be for a passenger platform on the left of the A cars and the right doors of the B cars would open for the same platform. The door selection circuit 782 provides an output to open the right doors of the A vehicles and the left doors of the B vehicles for an A head end car arrangement, with the passenger platform on the right side of the train when the train moves into the station and stops.

Figure 8A:
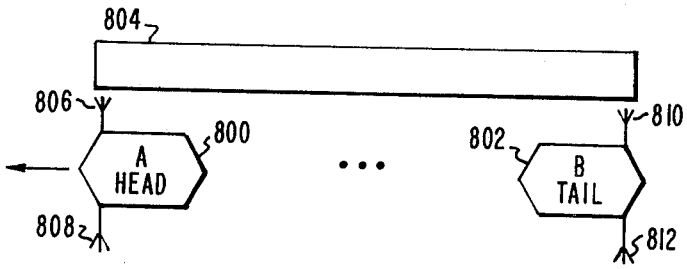
FIGS. 8A, 8B, 8C and 8D illustrate various vehicle arrangements in a typical train.
Figure 8B:
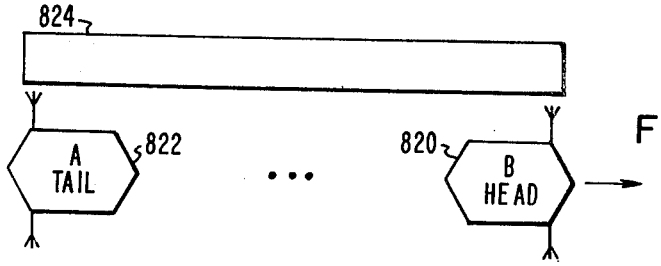
Figure 8C:
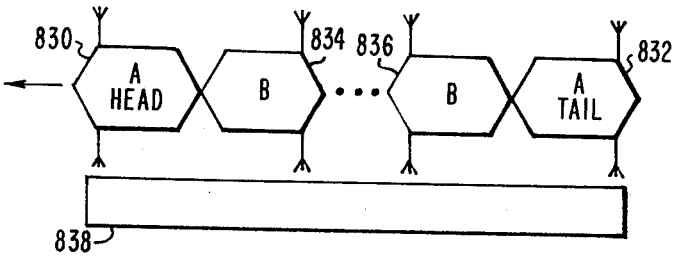
Figure 8D:
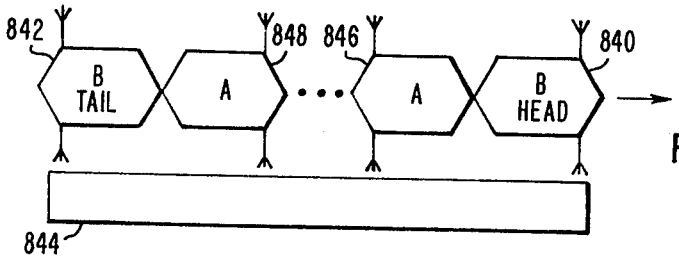

In FIGS. 8A, 8B, 8C and 8D there are shown sketches of various train arrangements of passenger vehicles positioned within a station. In FIG. 8A there is shown an A head end vehicle 800 and a B tail end vehicle 802 positioned within a station including a platform 804. Each vehicle includes door signal sensing antennas such as the antennas 806 and 808 of the A head end vehicle 800, and the antennas 810 and 812 of the B tail end vehicle. In FIG. 8B there is shown a B head end vehicle 820 and an A tail end vehicle 822 positoned within a station and in relation to a passenger loading and unloading platform 824. In FIG. 8C there is shown an A head end vehicle 830 and an A tail end vehicle 832 positioned within a station. The A head end vehicle is paired with a B vehicle 834 and the A tail end vehicle 832 is paired with a B vehicle 836. In FIG. 8D there is shown a B head end vehicle 840 and a B tail end vehicle 842 positioned within a station and including the platform 844 with the B head end vehicle being paired with the A vehicle 846, and the B tail end vehicle 842 being paired with the A vehicle 848.

In general, the head end vehicle leads the train of vehicles when the train is moving along the track.

What is claimed is:

1. In apparatus for controlling the doors of a train of passenger vehicles in response to open door signals, with said train having a head end and a tail end, the combination of:

first means for decoding an open door first signal received at the head end of the train and comparing the received first signal with a previous value of that first signal to establish a first good door code signal, second means for decoding an open door second signal received at the tail end of the train and comparing the received second signal with a previous value of that second signal to establish a second good door code signal, door control means operative with the first means and the second means for determining that each of the open door first signal and the open door second signal is requesting that the doors of the train be opened on the same side of the train, means providing a door enable signal in response to said first and second good door code signals, and means responsive to the door enable signal for controlling the doors of the train.

2. The apparatus of claim 1, with said means providing a door enable signal being operative in relation to one side of the train, and with said means for controlling the doors being responsive to said door enable signal for controlling the doors of the train for the side corresponding to that provided door enable signal.

3. The apparatus of claim 1, including:

means providing a zero speed signal when said train is moving at less than a predetermined speed, with said means providing a door enable signal being responsive to said zero speed signal for controlling the doors of the train.

4. The apparatus of claim 1, with said open door first and second signals being digital signals and with the decoding provided by each of the first and second means including the comparison of a present open door signal number of bits with a previous open door signal number of bits.

5. The apparatus of claim 1, with each of said first means and said second means decoding the respective open door first and second signals when the train speed is less than a first predetermined train speed, and with said means for controlling the doors being operative to open the doors when the train speed is at a second predetermined speed lower than said first speed.

6. The apparstus of claim 1, with each of the first and second means providing good door code signals when the respective open door first and second signals are received in a predetermined period of time.

7. The apparatus of claim 1, including:

means providing an indication of a roll back condition of the train of vehicles, with said door enable signal providing means being responsive to said indication to prevent the provision of said door enable signal.

8. The apparatus of claim 1, with each of said open door first and second signals comprising digital bits of data, and with each of said first and second means establishing that a predetermined number of bits of said data having a predetermined frequency is received for the respective open door first and second signals before said door enable signal is provided.

9. The method of controlling the doors of a train of vehicles in response to a head end open door signal and a tail end open door signal, including the steps of decoding the head end open door signal and comparing the decoded head end open door signal with a past value of the decoded head end open door signal to establish that a valid head end door code signal is received, decoding the tail end open door signal and comparing the decoded tail end open door door signal with a past value of the decoded tail end open door door signal to establish that a valid tail end door code signal is received, providing a door enable control signal when both a valid head end door code signal is received and a valid tail end door code signal is received in relation to the same side of the train, and opening the doors of the train for that same side in response to said door enable control signal.

10. The method of claim 9, including:

determining the movement speed of the train, and providing said door enable signal when the train is moving at less than a predetermined speed.

11. The method of claim 9, including the step of:

providing said door enable signal after a predetermined number of decodings of each of said head end and tail end open door signals.

* * * * *